US008597057B2

(12) United States Patent
Yu et al.

(10) Patent No.: US 8,597,057 B2
(45) Date of Patent: Dec. 3, 2013

(54) ELECTRICAL CARD CONNECTOR WITH REINFORCED CARD LOCKING

(75) Inventors: Jian-Fei Yu, Kunshan (CN); Fang-Yue Zhu, Kunshan (CN); Qi-Jun Zhao, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 49 days.

(21) Appl. No.: 13/345,396

(22) Filed: Jan. 6, 2012

(65) Prior Publication Data

US 2012/0178302 A1 Jul. 12, 2012

(51) Int. Cl.
*H01R 24/00* (2011.01)

(52) U.S. Cl.
USPC ..... 439/630; 439/159

(58) Field of Classification Search
USPC ..... 439/631, 630, 159; 235/441
See application file for complete search history.

(56) References Cited

U.S. PATENT DOCUMENTS 7,484,977 B2 * 2/2009 Hsiao ..... 439/160
7,578,703 B2 * 8/2009 Hsiao ..... 439/630
7,682,168 B2 * 3/2010 Hsiao ..... 439/159
7,909,628 B2 * 3/2011 Yu et al. ..... 439/159
8,308,495 B2 * 11/2012 Yu et al. ..... 439/159
2010/0267260 A1 * 10/2010 Yu et al. ..... 439/159
2011/0034050 A1 * 2/2011 Zhu et al. ..... 439/159
2011/0230072 A1 * 9/2011 Yu et al. ..... 439/159

FOREIGN PATENT DOCUMENTS

CN 201018110 Y 2/2008

* cited by examiner

*Primary Examiner* — Hae Moon Hyeon
(74) *Attorney, Agent, or Firm* — Wei Te Chang; Ming Chieh Chang

(57) ABSTRACT

An electrical card connector for holding a card with a notch defined on a lateral side thereof, includes an insulative housing, a number of contacts and a push-push mechanism. The push-push mechanism includes a slider movable between an initial position and a final locking position along a front-to-back direction, a spring abutting against the slider and an elastic locking arm having a card lock for locking with the notch of the card. The slider further includes a rigid protrusion to engage with the notch of the card. The rigid protrusion not only helps the card lock hold the card when the slider is located at the final locking position, but also helps the card lock prevent the card from flying out of the card receiving space when the slider moves from the final locking position back to the initial position.

19 Claims, 7 Drawing Sheets

ELECTRICAL CARD CONNECTOR WITH REINFORCED CARD LOCKING

BACKGROUND OF THE INVENTION

1. Field of the Invention

The present invention relates to an electrical card connector, more particularly to an electrical card connector with a push-push mechanism.

2. Description of Related Art

Chinese Patent Issue No. CN 201018110Y issued on Feb. 6, 2008 to the same assignee of the present invention, discloses a conventional electrical card connector for receiving a card. The electrical card connector includes an insulative housing, a plurality of contacts fixed in the insulative housing, a push-push mechanism and a metal shell covering the insulative housing. The insulative housing defines a card receiving space for accommodating the card. The push-push mechanism includes a slider moveable along the card insertion direction, a coiled spring abutting against the slider, a link rod connecting the insulative housing and the slider, and a locking arm retained on the slider for holding the card. The slider includes a receiving slot for receiving the locking arm. The locking arm includes a fixing portion fixed in the slider and an elastic locking protrusion extending into the card receiving space. However, since the elastic locking protrusion itself is weak and the card locking type is single, only depending on the elastic locking protrusion locking with a notch of the card, it is hard to stably lock the card in position and prevent the card from being pulled out of the card receiving space. Besides, since the locking force between the locking protrusion and the card is slight, the card may easily fly out of the card receiving space during the card ejection process.

Hence, an improved electrical card connector with improved card locking features is needed to solve the above problem.

BRIEF SUMMARY OF THE INVENTION

An electrical card connector for holding a card with a notch defined on a lateral side thereof, includes an insulative housing defining a card receiving space for accommodating the card, a plurality of contacts with contacting portions extending into the card receiving space for mating with the card, and a push-push mechanism located at one side of the card receiving space. The push-push mechanism includes a slider movable along a front-back direction, a spring abutting against the slider and a metal locking arm fixed to the slider. The slider includes an engaging portion extending into the card receiving space for being pushed by the card so that the slider is moveable between a front initial position where the card is initially inserted into the card receiving space and a rear locking position where the card is ultimately locked in position within the card receiving space. The slider includes a sideward protrusion extending into the card receiving space. The metal locking arm includes a card lock adjacent to the protrusion and extending into the card receiving space along the same direction of the protrusion. When the slider is located at the rear locking position, both the card lock and the protrusion are locking with the notch of the card. When the slider moves from the rear locking position back to the front initial position, the card lock cooperates with the protrusion to lock with the notch of the card so as to prevent the card from flying out of the card receiving space.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details.

Figure 1:
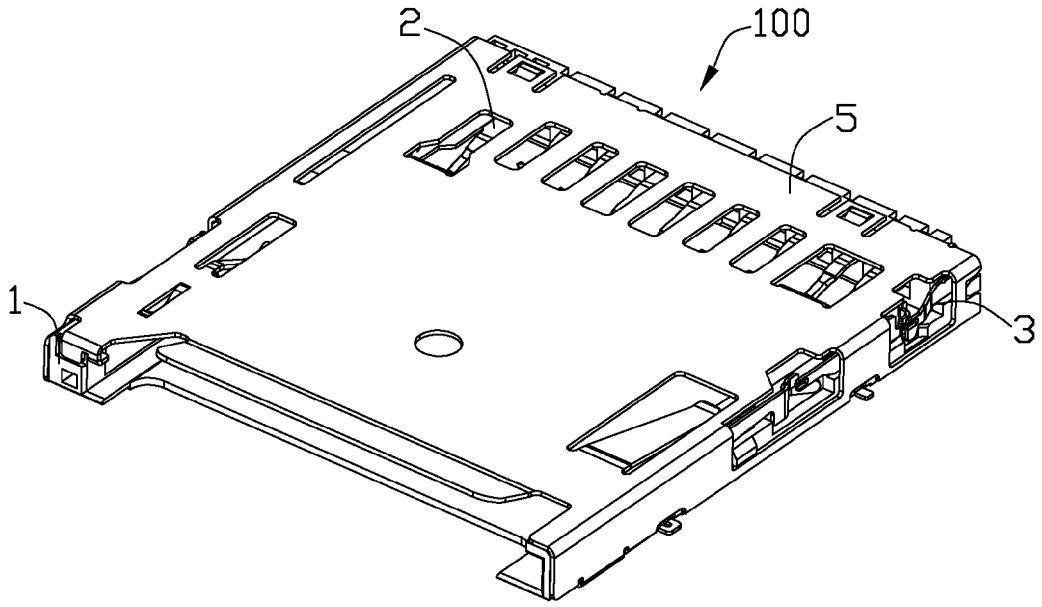
FIG. 1 is a perspective view of an electrical card connector according to an illustrated embodiment of the present invention.
Figure 7:
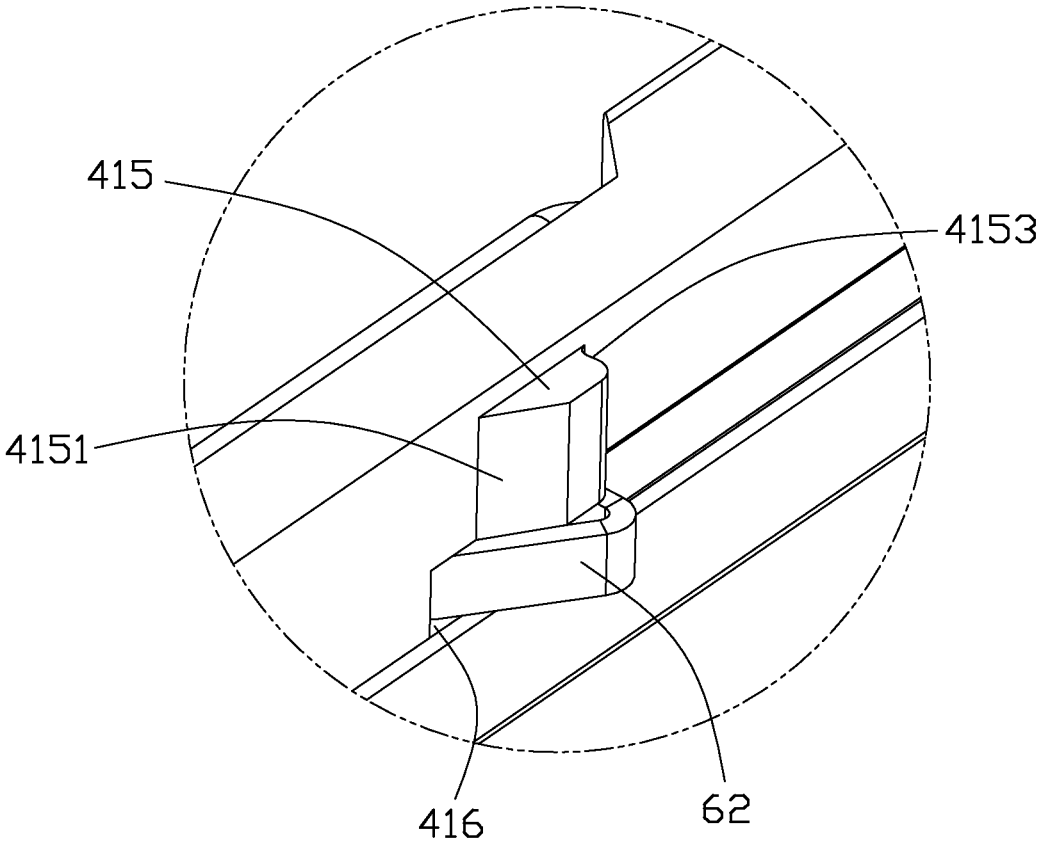
FIG. 7 is a partly enlarged view of the circle portion as shown in FIG. 3.

Referring to FIGS. 1 and 7, an electrical card connector 100 adapted to be mounted on a printed circuit board (not shown) for receiving an electrical card (not shown) is disclosed. The electrical card can be set as a secure digital card which is provided with a notch defined on a lateral side thereof. The electrical card connector 100 includes an insulative housing 1, a plurality of contacts 2 fixed to the insulative housing 1, a detect contact group 3 mounted at one side of the insulative housing 1, a push-push mechanism 4 located at the other side of the insulative housing 1 and a metal shell 5 covering the insulative housing 1. The metal shell 5 is attached to the insulative housing 1 to form a card receiving space 10 for receiving the electrical card. However, in other embodiments, the card receiving space 10 can be defined only by the insulative housing 1.

Referring to FIGS. 2, 3, 5 and 6, the insulative housing 1 includes a bottom wall 13, a front insertion face 14, a side wall 12 extending upwardly from the bottom wall and a mounting wall 15 at the rear of the card receiving space 10 for mounting the contacts 2. The card receiving space 10 is backwardly recessed from the insertion face 14 and located above the bottom wall 13. One side of the bottom wall 13 is connected to the side wall 12, and the other side of the bottom wall 13 and the side wall 12 includes a plurality of embosses 131 for locking with the metal shell 5. The bottom wall 13 defines a guiding slot 130 for guiding movement of the push-push mechanism 4. The mounting wall 15 includes a mounting post 150 near the bottom wall 13, and the mounting post 150 extends forwardly for positioning the push-push mechanism 4. The bottom wall 13 further includes a position block 17 opposite to the side wall 12 and adjacent to a front side of the bottom wall 13. The position block 17 defines a position hole 171 at an out side thereof.

Figure 2:
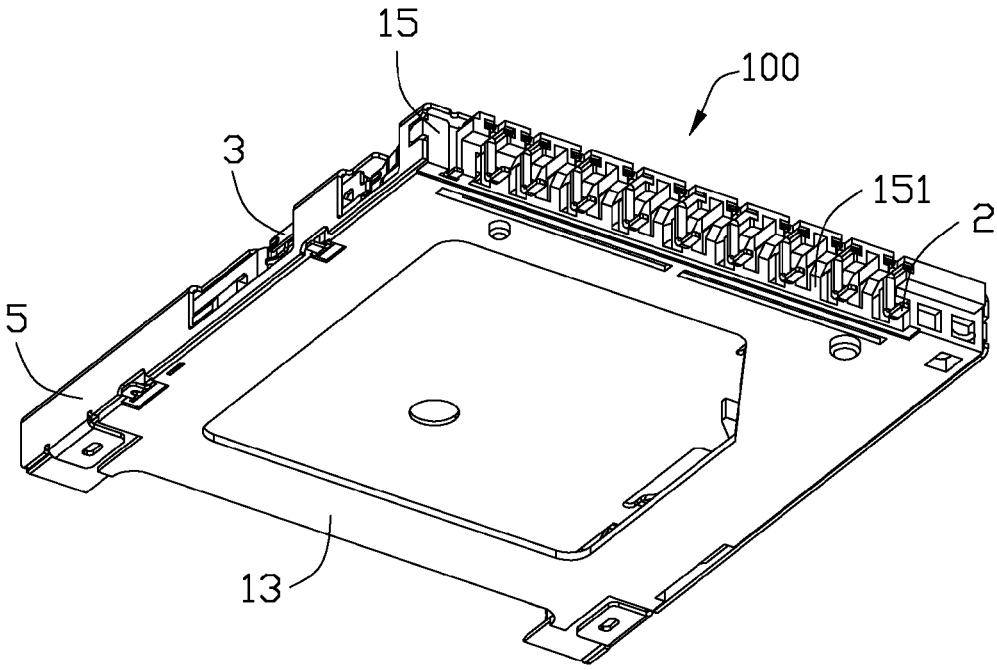
FIG. 2 is another perspective view of the electrical card connector as shown in FIG. 1.
Figure 5:
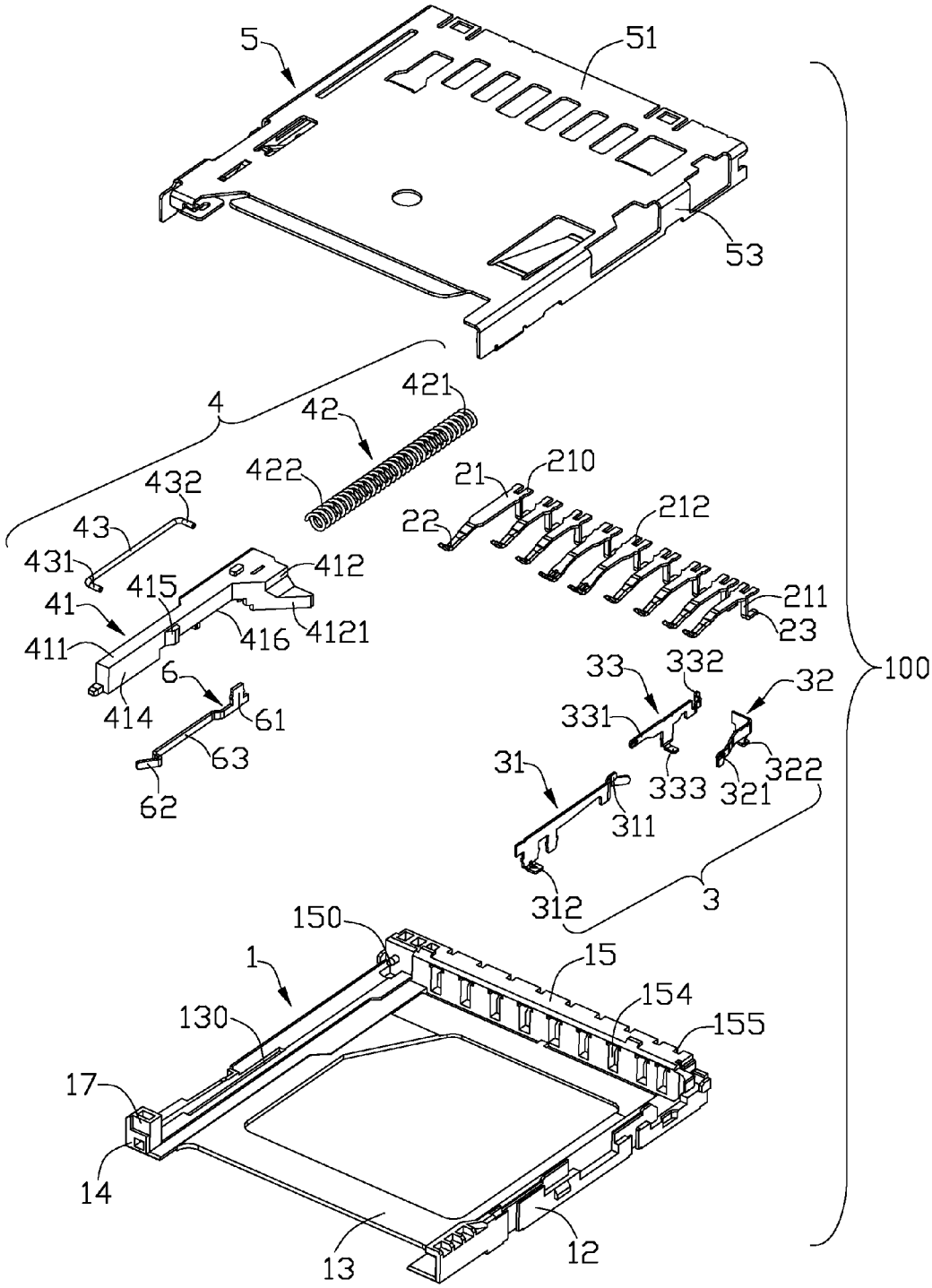
FIG. 5 is an exploded view of the electrical card connector.

Referring to FIGS. 2 and 5, the mounting wall 15 defines an escaping space 151 for receiving the contacts 2. The escaping space 151 is exposed to the out side backwardly and downwardly. The mounting wall 15 includes a plurality of horizontal slots 155 above the escaping space 151 and a plurality of vertical escaping slots 154 in a front of the escaping space 151. In this arrangement, the contacts are received in the escaping space 151 and do not extend beyond the mounting wall 5, so the whole profile of the electrical card connector 100 can be decreased so as to occupy less area of the PCB. Besides, retaining force for fastening the contacts 2 to the mounting wall 15 is unchanged so that the contacts 2 can still be stably fixed in the insulative housing 1.

Figure 3:
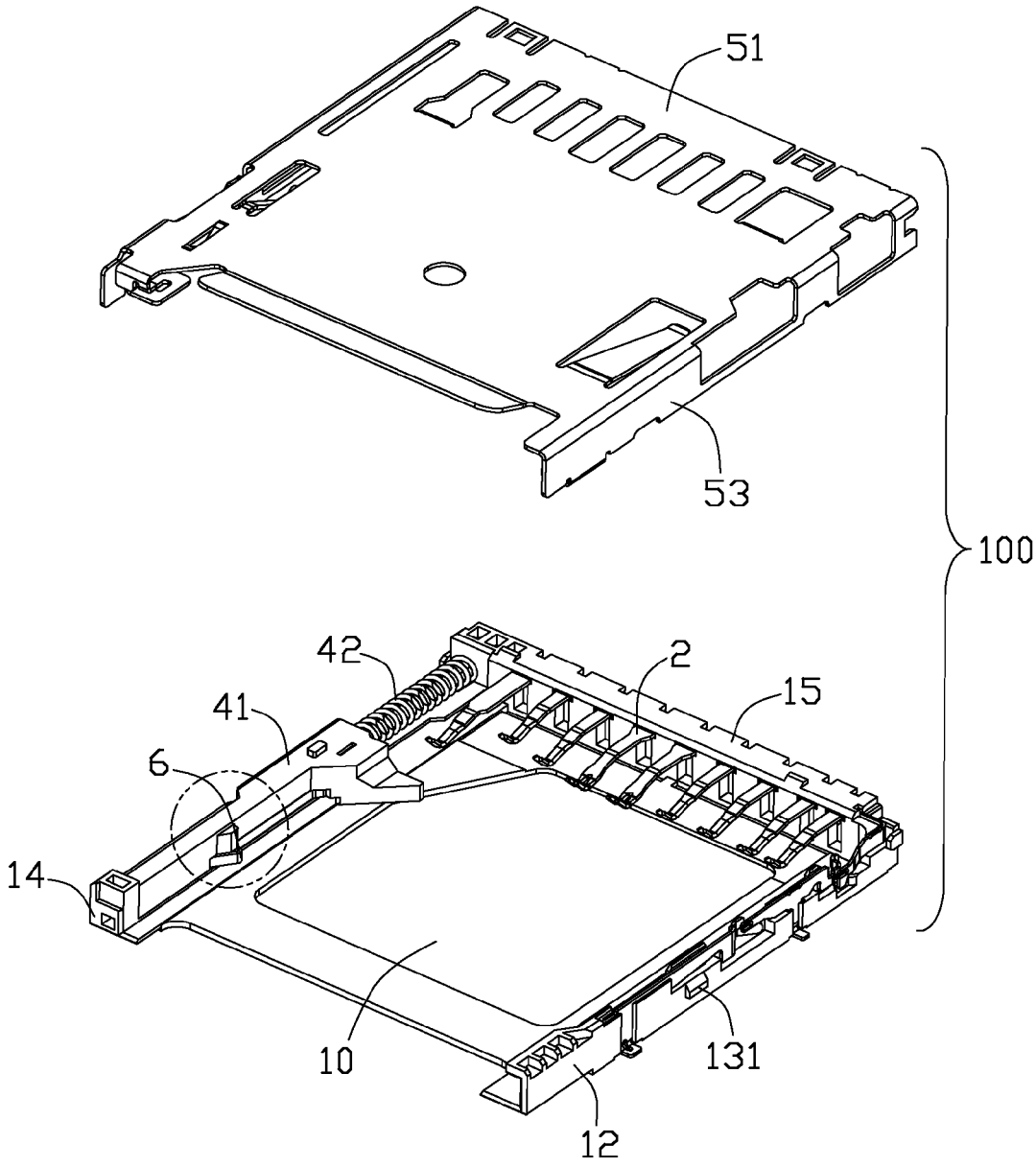
FIG. 3 is a partly exploded view of the electrical card connector according to the illustrated embodiment of the present invention.
Figure 4:
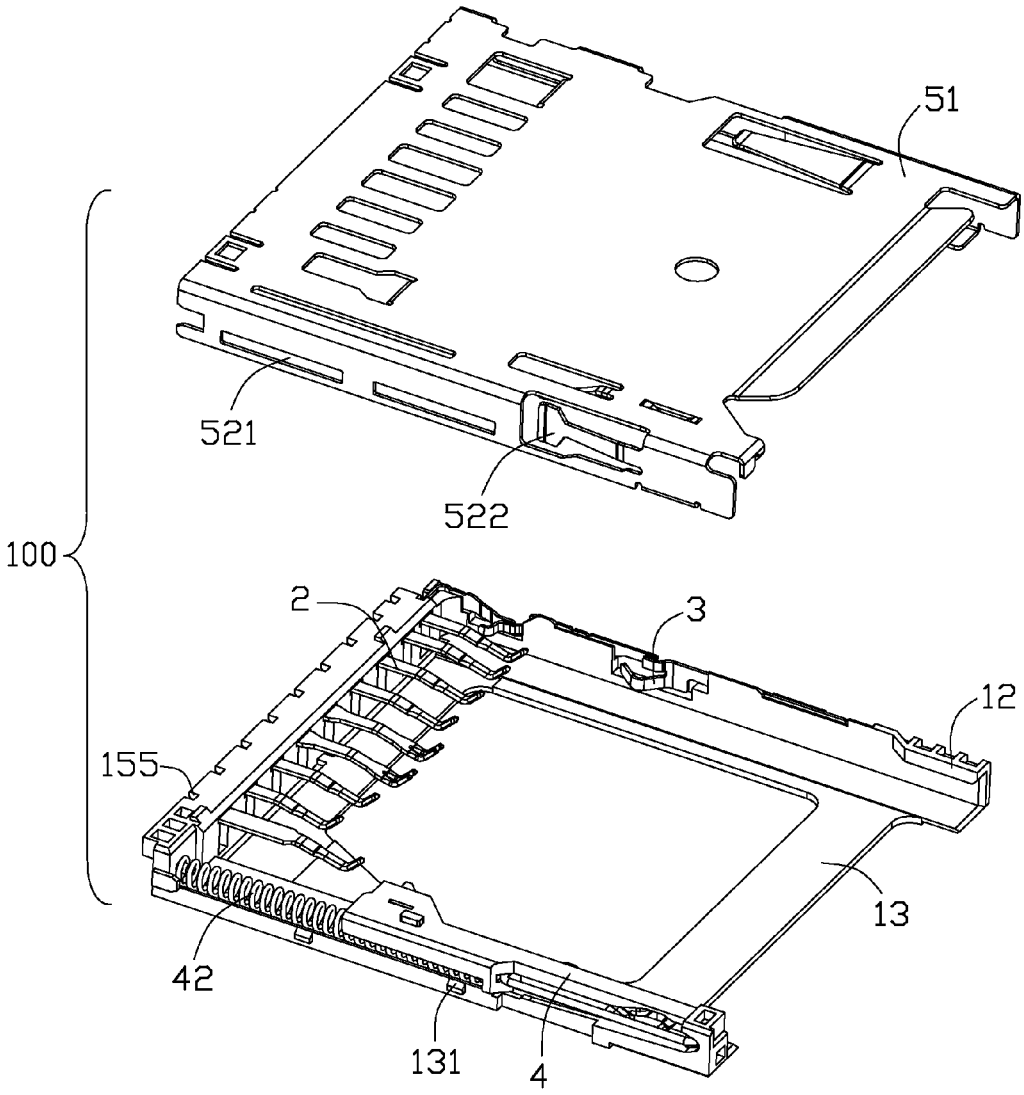
FIG. 4 is another partly exploded view of the electrical card connector as shown in FIG. 3.

Referring to FIGS. 3 to 5, the contacts 2 are fixed to the mounting wall 15, and each contact 2 includes a fastening portion 21 received in the horizontal slots 155, a contacting portion 22 extending forwardly from the fastening portion 21 and extending downwardly into the card receiving space 10 for mating with the electrical card, and a soldering portion 23. The soldering portions 23 are accommodated in the escaping space 151 and corresponding to the vertical escaping slots 154. Under this arrangement, the vertical escaping slots 154 are adapted not only for dispersing residual stress of the insulative housing 1, but also for heating dissipation when the soldering portions 23 are soldered to the PCB. Each contact 2 further includes a vertical portion 211 extending downwardly from the fastening portion 21. The soldering portion 23 extends backwardly from a bottom of the vertical portion 211. The vertical portion 211 and the soldering portion 23 are received in the escaping space 151. The fastening portion 21 includes a pair of distal ends 210 extending backwardly beyond the vertical portion 211, and a slit 212 defined between the distal ends 210.

The detect contact group 3 includes a first detect contact 31 mounted at the front of the side wall 12, a second detect contact 32 mounted at the rear of the side wall 12, and a common contact 33 between the first detect contact 31 and the second detect contact 32. The first detect contact 31 includes a first engaging arm 311 for engaging with the electrical card and a first soldering portion 312 soldered to the PCB. The second detect contact 32 includes a second engaging arm 321 for engaging with the common contact 33 and a second soldering portion 322 soldered to the PCB. The common contact 33 includes a third engaging arm 331 for engaging with the first detect contact 31, a fourth engaging arm 332 for engaging with the second detect contact 32, and a third soldering portion 333 soldered to the PCB. When the electrical card is just inserted into the card receiving space 10, the first engaging arm 311 is driven by the electrical card to contact the third engaging arm 331 of the common contact 33 so as to realize a first detection. Then, with insertion of the electrical card, the fourth engaging arm 332 of the common contact 33 is driven by the electrical card to contact the second engaging arm 321 of the second detect contact 32 so as to realize a second detection.

The push-push mechanism 4 includes a slider 41 movably set on the bottom wall 13 and located opposite to the side wall 12, a coiled spring 42 compressed between the mounting wall 15 and the slider 41, a link rod 43 slidable in the slider 41 for controlling positions of the slider 41, and an elastic metal locking arm 6 fixed to the slider 41.

Referring to FIGS. 3 to 7, the slider 41 is substantially L-shaped and includes a main body 411 extending along a card insertion direction and an engaging portion 412 extending into the card receiving space 10 for being pushed by the electrical card. The main body 411 includes a guiding protrusion 4123 extending downwardly to be slidable in the guiding slot 130 along the front-to-back direction. The engaging portion 412 includes an inclined surface 4121 for engaging with the electrical card so that the slider 41 is pushed to be moveable between a front initial position where the electrical card is initially inserted into the card receiving space 10 and a rear locking position where the electrical card is ultimately locked in position within the card receiving space 10. The slider 41 further includes an inner surface 414 formed on the main body 411 and directly facing the card receiving space 10, a sideward protrusion 415 extending into the card receiving space 10 from the inner surface 414, and a receiving slot 416 formed at the bottom of main body 411 for receiving the locking arm 6. In accordance with the illustrated embodiment of the present invention, the protrusion 415 is rigid and is integrally formed with the slider 41. As shown in FIG. 7, the protrusion 415 includes a front inclined guiding surface 4151 facing an opening of the card receiving space 10 for guiding insertion of the electrical card, and a rear stopping surface 4153 facing the mounting wall 15 for resisting against the notch of the electrical card. The main body 411 of the slider 41 defines an outer side opposite to the protrusion 415. The outer side defines a heart-shaped cam 413 for regulating the link rod 43. Besides, the slider 41 further includes a second mounting post 4122 at a front end of the main body 411. A bottom of a rear end of the engaging portion 412 facing the bottom wall 13 defines a fixing slit 4124 for mounting the locking arm 6. The spring 42 includes a first engaging end 421 fixed to the first mounting post 150 and a second engaging end 422 fixed to the second mounting post 4122, as a result that two opposite ends of the spring 42 are positioned. The link rod 43 includes a rear movable end 432 sliding in the heart-shaped cam 413 so as to control the slider 41, and a front free end 431 received in the position hole 171.

Referring to FIGS. 5 and 7, the locking arm 6 includes a fixing portion 61 fixed in the fixing slit 4124 of the slider 41, a cantilevered arm 63 extending forwardly from the fixing portion 61 to be received in the receiving slot 416, and a card lock 62 located at a distal end of the cantilevered arm 63. The card lock 62 sidewardly protrudes into the card receiving space 10 for locking with the notch of the electrical card when the electrical card is inserted into the card receiving space 10. The protrusion 415 is located above the card lock 62 along a vertical direction. Referring to FIG. 7, the protrusion 415 and the card lock 62 at least partly overlap with each other along the vertical direction perpendicular to the front-back direction. The card lock 62 is located under the protrusion 415. Besides, the protrusion 415 and the card lock 62 are offset from each other along the vertical direction. The card lock 62 laterally protrudes beyond the protrusion 415 so that the card lock 62 contacts the electrical card prior to the protrusion 415.

Figure 6:
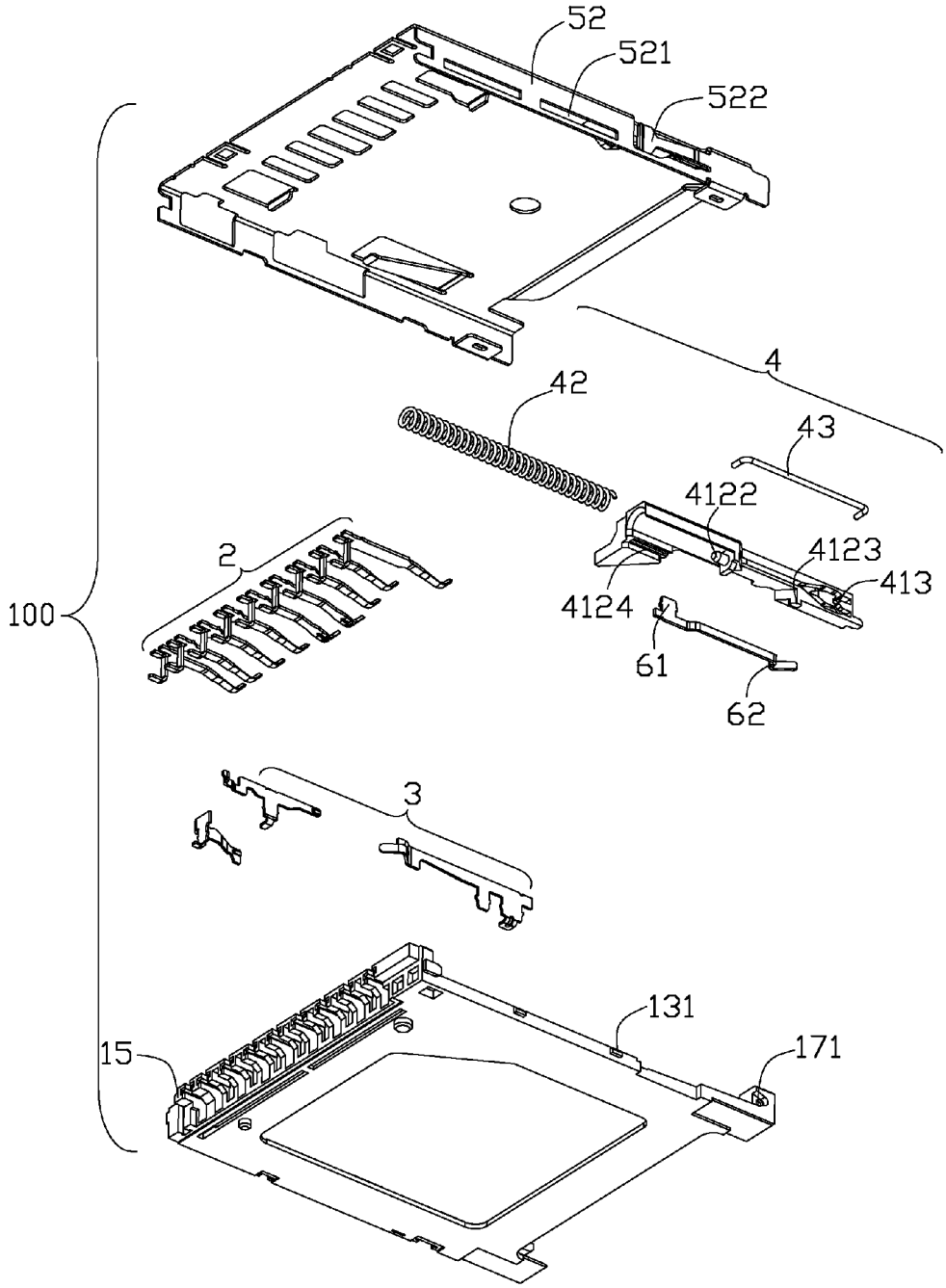
FIG. 6 is another exploded view of the electrical card connector as shown in FIG. 5.

Referring to FIGS. 5 and 6, the metal shell 5 is stamped from a metal sheet and includes a top wall 51 and a pair of first and second bending walls 52, 53 extending downwardly from lateral sides of the top wall 51. The first bending wall 52 includes a slot 521 for receiving the embosses 131 and a pressing spring 522 for pressing the link rod 43 so as to prevent the link rod 43 from falling off from the heart-shaped cam 413.

According to the present invention, when the electrical card is just inserted into card receiving space 10, the card lock 62 is outwardly driven by the electrical card to get deformable. Under the guiding of the guiding surface 4151 of the protrusion 415 and the card lock 62, the electrical card ultimately passes the protrusion 415 and the card lock 62 with the protrusion 415 and the card lock 62 both engaging with the notch of the electrical card to improve locking force. With further insertion of the electrical card, the engaging portion 412 of the slider 41 is driven by the electrical card to slide backwardly from the front initial position to reach the rear locking position. Under this condition, even if a pulling force is applied to the electrical card, much more resistance is needed to overcome before the electrical card and can be pulled out from the electrical card connector 100. Besides, when the electrical card is needed to withdraw from the card receiving space 10, the electrical card is pushed again. During the slider 41 moving from the rear locking position back to the front initial position, the protrusion 415 helps the card lock 62 to prevent the electrical card from flying out of the card receiving space 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

What is claimed is:

1. An electrical card connector adapted for holding a card with a notch defined on a lateral side thereof, comprising:
- an insulative housing defining a card receiving space for accommodating the card;
- a plurality of contacts with contacting portions extending into the card receiving space for mating with the card; and
- a push-push mechanism located at one side of the card receiving space, the push-push mechanism comprising a slider movable along a front-to-back direction, a spring abutting against the slider and a metal locking arm fixed to the slider, the slider comprising an engaging portion extending into the card receiving space for being pushed by the card so that the slider is moveable between a front initial position where the card is initially inserted into the card receiving space and a rear locking position where the card is ultimately locked in position within the card receiving space; wherein
- the slider comprises a sideward protrusion extending into the card receiving space, and the metal locking arm comprises a card lock adjacent to the protrusion and extending into the card receiving space along the same projecting direction of the protrusion; and the protrusion and the card lock overlap with each other along a vertical direction for engaging with the notch of the card.

2. The electrical card connector as claimed in claim 1, wherein the protrusion is located above the card lock along the vertical direction.

3. The electrical card connector as claimed in claim 2, wherein the slider defines a receiving slot under the protrusion, the card lock passes through the receiving slot and into the card receiving space.

4. The electrical card connector as claimed in claim 1, wherein the card lock laterally protrudes beyond the protrusion.

5. The electrical card connector as claimed in claim 3, wherein the protrusion has a front inclined guiding surface for guiding insertion of the card and a rear stopping surface opposite to the guiding surface.

6. The electrical card connector as claimed in claim 1, wherein the protrusion is integral with the slider.

7. The electrical card connector as claimed in claim 1, wherein the metal locking arm comprises a fixing portion fixed to the slider and a cantilevered arm extending forwardly from the fixing portion, the card lock is located at a distal end of the cantilevered arm.

8. The electrical card connector as claimed in claim 1, wherein the slider defines an outer side opposite to the protrusion with a heart-shaped cam formed on the outer side, the spring is compressed between the slider and the insulative housing, the push-push mechanism further comprises a link rod having one end fixed in the insulative housing and the other end sliding in the heart-shaped cam when the slider moves along the front-to-back direction.

9. The electrical card connector as claimed in claim 1, wherein the insulative housing comprises a rear mounting wall to fix the contacts, each contact comprises a fastening portion, a vertical portion extending downwardly from the fastening portion and a horizontal soldering portion extending backwardly from the vertical portion, the rear mounting wall defining a plurality of horizontal slots to fix the fastening portions and a plurality of vertical escaping slots corresponding to the vertical portions; and the vertical escaping slots are adapted not only for dispersing residual stress but also for heating dissipation when the soldering portions are soldered to a Printed Circuit Board.

10. The electrical card connector as claimed in claim 9, wherein the mounting wall defines an escaping space located under the horizontal slots and receiving the soldering portions, the horizontal slots and the vertical escaping slots communicate with the escaping space.

11. An electrical card connector adapted for holding a card with a notch defined on a lateral side thereof, comprising:
- an insulative housing cooperative with a metal shell to define a card receiving space for accommodating the card;
- a plurality of contacts with contacting portions extending into the card receiving space for mating with the card; and
- a push-push mechanism comprising a slider movable between an initial position and a final locking position along a front-to-back direction, a spring abutting against the slider and an elastic locking arm having a card lock protruding into the card receiving space for locking with the notch of the card; wherein
- the slider further comprises a rigid protrusion located adjacent to the card lock and protruding into the card receiving space for locking with the notch of the card as well.

12. The electrical card connector as claimed in claim 11, wherein the protrusion and the card lock at least partly overlap with each other along a vertical direction perpendicular to the front-to-back direction.

13. The electrical card connector as claimed in claim 12, wherein the card lock is located under the protrusion.

14. The electrical card connector as claimed in claim 11, wherein the card lock laterally protrudes beyond the protrusion.

15. The electrical card connector as claimed in claim 11, wherein the protrusion is integral with the slider.

16. An electrical card connector for use with a card having a notch in the side edge, comprising:
- an insulative housing defining therein a card receiving space communicating with an exterior along a front-to-back direction;

a metallic shell attached to the housing to cover the card receiving space in a vertical direction perpendicular to said front-to-back direction;

a plurality of contacts disposed in the housing with contacting sections extending into the card receiving space in said vertical direction;

a slider disposed beside the card receiving space in a transverse direction perpendicular to both said front-to-back direction and said vertical direction and back and forth moveable relative to the housing in said front-to-back direction; and a locking structure formed on an inner side of the slider facing toward the card receiving space for receipt within the notch of the card, and including a first inward protrusion and a second inward protrusion; wherein the first inward protrusion extends inwardly beyond the second inward protrusion in said transverse direction while when said locking structure is received in the notch of the card, the second inward protrusion is stiffer than the first inward protrusion so as to form two-stage retention for preventing inadvertent flip-out of the card during ejection of the slider.

17. The electrical card connector as claimed in claim 16, wherein the first inward protrusion and the second inward protrusion are discrete from each other at different levels in the vertical direction.

18. The electrical card connector as claimed in claim 17, wherein said first inward protrusion is formed by a metallic strip while the second inward protrusion is formed unitarily on the slider.

19. The electrical card connector as claimed in claim 18, wherein said first inward protrusion is essentially deflectable with regard to the card while the second inward protrusion is essentially interferential with regard to the card.

* * * * *